US005784812A

United States Patent [19]

Leidinger et al.

[11] Patent Number: 5,784,812

[45] Date of Patent: Jul. 28, 1998

[54] METHOD OF CONTROLLING THE POSITIONING OF AN OUTFIT TILTING CYLINDER MOUNTED ON THE DESCENDING LIFT FRAME OF MOVABLE CONSTRUCTION MACHINES

[75] Inventors: Gustav Leidinger, Friedberg; Walter Kolb, Augsburg; Günter Brönner, Kissing, all of Germany

[73] Assignee: O&K Orenstein & Koppel AG, Berlin, Germany

[21] Appl. No.: 666,436

[22] PCT Filed: Jul. 12, 1995

[86] PCT No.: PCT/EP95/02721

§ 371 Date: Jan. 10, 1997

§ 102(e) Date: Jan. 10, 1997

[87] PCT Pub. No.: WO96/02707

PCT Pub. Date: Feb. 1, 1996

[30] Foreign Application Priority Data

Jul. 13, 1994 [DE] Germany ..... 44 24 621.8
Oct. 19, 1994 [DE] Germany ..... 44 37 300.7

[51] Int. Cl.[6] ..... E02F 5/02

[52] U.S. Cl. ..... 37/348; 701/50; 91/516

[58] Field of Search ..... 37/348, 382, 195, 37/414–416; 172/4, 4.5, 6; 364/424.07; 414/699, 694; 60/545; 701/50; 91/516, 945, 447

[56] References Cited

U.S. PATENT DOCUMENTS

| | | | |
|---|---|---|---|
| 3,484,010 | 12/1969 | Campbell . | |
| 3,726,428 | 4/1973 | Lark et al. . | |
| 4,400,934 | 8/1983 | Oberlander | 60/39.07 |
| 4,655,511 | 4/1987 | Leiber | 303/92 |
| 5,426,874 | 6/1995 | Nakata et al. | 37/348 |
| 5,446,979 | 9/1995 | Sugiyama et al. | 37/348 |
| 5,488,787 | 2/1996 | Aoyagi et al. | 37/348 |
| 5,497,568 | 3/1996 | Strickland | 37/348 |
| 5,609,089 | 3/1997 | Leidinger | 91/516 |

FOREIGN PATENT DOCUMENTS

| | | |
|---|---|---|
| 4128959 | 3/1993 | Germany . |
| 2035464 | 6/1980 | United Kingdom . |

*Primary Examiner*—Terry Lee Melius
*Assistant Examiner*—Victor Batson
*Attorney, Agent, or Firm*—Spencer & Frank

[57] ABSTRACT

A method for the positionally correct placement of an operating equipment including a scoop tiltably disposed on a descending lift frame of a mobile machine including a wheeled loader. An automatic positioning device is actuated thereby activating a first magnetic valve utilizing a logical switching device cooperating with the automatic positioning device for switching a tilting piston of a control slide operatively connected to a tilting cylinder and to the lift frame into a position in which the control slide releases an oil flow to the tilting cylinder. The oil flow is delivered utilizing a controlled pump. A plurality of measurements is performed of a traveled distance of a piston rod of the tilting cylinder at predeterminable places during a continued extension of the piston rod thereby obtaining distance measurement values. A first signal is triggered in response to a first one of the distance measurement values for activating a second magnetic valve utilizing the logical switching device for moving the tilting piston into a position where a predeterminable reduced oil flow is released to the tilting cylinder. During a slowed-down, extending movement of the piston rod, a second signal is triggered in response to a second one of the measurement values for deactivating the logical switching device with respect to the first magnetic valve and the second magnetic valve and for interrupting an oil flow to the tilting cylinder.

16 Claims, 2 Drawing Sheets

METHOD OF CONTROLLING THE POSITIONING OF AN OUTFIT TILTING CYLINDER MOUNTED ON THE DESCENDING LIFT FRAME OF MOVABLE CONSTRUCTION MACHINES

The invention relates to a method for the positionally correct placement of an operating tool, in particular a scoop, tiltably disposed on a descending lift frame of a mobile machine, in particular a wheeled loader.

BACKGROUND OF THE INVENTION

Mobile machines, in particular wheeled loaders, have operating equipment, in particular scoops, which are seated on the frame of the machine by means of a lifting frame which can be raised and lowered. It is as a rule sensible in connection with the normal operating state of the machine, in particular the wheeled loader, that the operating equipment, in particular the scoop, has reached a position following the lowering of the lifting frame, which allows problem-free further operation without involved corrections by the driver. As a rule, this position is one which extends approximately parallel with the surface to be worked. In many cases mobile machines are provided with an automatic return for the operating equipment, in particular the scoop, which, following activation preferably by pushing a button, in the course of lowering of the lifting frame brings the operating equipment back into the predetermined operating position, in particular scooping. Because of the different conditions during the switching time of the valves, mainly because of the pump conveying stream which changes within wide margins because of the rpm of the Diesel engine, this return operates inaccurately, i.e. the angle at which the working equipment, in particular the scoop bottom, comes to rest on the ground fluctuates so strongly that for setting the most favorable cutting angle into the material, the driver has to make corrections from one instant to the next.

A scoop loader device on any arbitrary operating vehicle is known from DE-A 41 28 959, wherein at least one tilting cylinder is hinged at one end on the loader frame above the loading rocker, and at the other end on a tilting lever which is pivotable on the loading rocker, to form a parallel kinematic arrangement which maintains the loading scoop, which is indirectly connected with the tilting lever, in its pivot position, open towards the top, evenly over the entire lifting range of the loading rocker. The tilting cylinder has an extended piston rod section passed through the cylinder bottom, whose length corresponds at least to that of the piston stroke, and to which an appropriate receptacle, which is fastened to the cylinder and provided with a bearing eye and with lateral access for replacing the seals of the cylinder bottom, is assigned. The extended piston rod constitutes a path-measuring member for a connectable electro-hydraulic control, by means of which the cylinder adjustment movement or the tilting movement of the loading scoop is stopped at a defined position which, in particular, corresponds to its pick-up position, wherein the scoop bottom generally extends parallel with the driving plane. Analogous with the general prior art described at the outset, this return system for the lifting frame also operates inaccurately in view of the different switching times of the valves because of the continuously changing rpm of the Diesel engine and therefore within wide margins, so that here, too, the adjustment work must be performed by the operator.

SUMMARY OF THE INVENTION

It is therefore the object of the invention to maintain the predeterminable angle of the operating equipment, in particular the scoop angle, constant within the majority of all occurring operating conditions in the course of lowering the lifting frame.

This object is attained on the one hand in that in the course of continued extension of the piston rod of the tilting cylinder, several measurements of the traveled distance of the piston rod are performed at predeterminable places, wherein the first measured value triggers a signal to the effect that the logical switching device activates a further magnetic valve which moves the tilting piston into a position in which a predeterminable reduced oil stream flows to the tilting cylinder, and that in the course of the further, but now slowed down, extending movement of the piston rod a further measured value triggers a further signal which deactivates the logical switching device of both magnetic valves and the oil flow to the tilting cylinder is interrupted.

On the other hand, this object is also attained that in the course of continued extension of the piston rod of the tilting cylinder, several measurements of the traveled distance of the piston rod are performed at predeterminable places, wherein the first measured value triggers a signal to the effect that the logical switching device activates a further magnetic valve and at the same time deactivates the first magnetic valve, because of which the tilting piston is moved into a position in which a predeterminable reduced oil stream flows to the tilting cylinder, and that in the course of the further, but now slowed down, extending movement of the piston rod a further measured value triggers a further signal so that the logical switching device now also deactivates the further magnetic valve and the oil flow to the tilting cylinder is interrupted.

Advantageous further developments of the method of the invention in accordance with the above ensue from the description to follow.

In accordance with alternative inventive concepts, wherein a further magnetic valve is activated by means of the logical switching device and the first magnetic valve is deactivated, the magnetic valve then conducts oil from the pilot control pump into an adjusting cylinder which can be brought into operative connection with the tilting cylinder. In accordance with the second alternative, the adjusting cylinder has a surface of such size that the force generated in the course of charging it with control pressure is greater, so that the tilting piston can only move as far as into a position which is predetermined by the stop of the piston.

In this case the position of this stop is selected to be such that the tilting piston still releases a control opening of such size that, on the basis of the load-sensing differential pressure set at the regulator of the hydraulic work pump, an amount of oil can pass which is approximately equal to or slightly less than the amount of oil which can be conveyed during the idling rpm of the Diesel engine. As soon as in the course of the further extension movement, now slowed, of the piston rod of the tilting cylinder, the control vane again leaves the operative range of the proximity switch, the latter is deactivated, i.e. its signal drops. Now either both magnetic valves (first alternative) or, in accordance with the second alternative, also the further magnetic valve are switched to be currentless by means of the logical switching device, so that the tilting piston is centered in its middle position by means of springs and thus the oil flow to the tilting cylinder is disrupted, because of which the piston rod of the tilting cylinder comes to a stop and therefore the end position of the operating equipment is predetermined.

The length of the control vane should preferably be fixed in such a way that, at the highest rpm of the drive motor and thus the greatest possible conveyed flow of the hydraulic work pump, during the time which passes from the triggering of the proximity switch, when the control vane approaches, either until the stop of the adjusting cylinder has been reached or until the position of the tilting piston predetermined by this stop, the piston rod of the tilting cylinder only travels a distance which is equal to or slightly less than the entire length of the control vane. By means of this step it is achieved that, insofar as the control vane leaves the operative range of the proximity switch and therefore the magnetic valves are again currentless via the logical control device, or now the further magnetic valve also becomes currentless again, a defined unchangeable adjustment speed of the piston rod has been set which is solely determined by the size of the control opening provided in this intermediate position of the tilting piston.

BRIEF DESCRIPTION OF THE DRAWINGS

The invention is represented in the drawings by means of an exemplary embodiment and will be described as follows. Shown are in FIG. 1 is a schematic representation of a circuit diagram which may be employed with a wheeled loader.

DETAILED DESCRIPTION OF THE INVENTION

Figure 1:
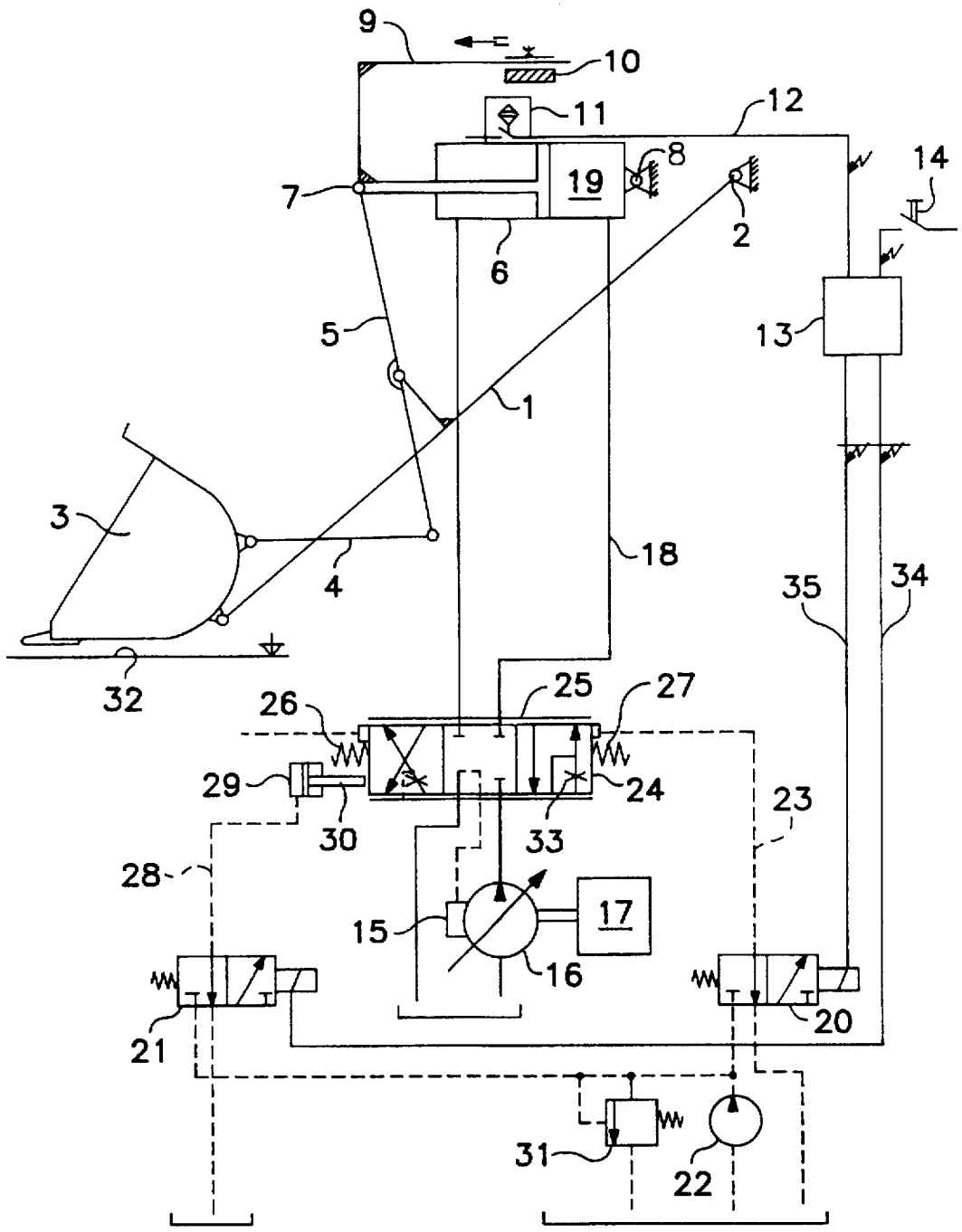

FIG. 1 shows in a schematic representation a circuit diagram which in this example can be employed with a wheeled loader, not shown in further detail.

The lifting frame 1 of the wheeled loader, which is hingedly seated on a hinge point 2 of the wheeled loader frame so it can be raised and lowered, is schematically represented. Operating equipment, here embodied as a scoop 3, is hinged at the lower end of the lifting frame 1 and can be actuated by means of a tilting cylinder 6 via a lever mechanism 4, 5. The tilting cylinder 6 contains a piston rod 7 and is itself hingedly fastened in the area of a hinge point 8 on the frame, not further shown, of the wheeled loader. A support bar 9 is fastened to the end of the piston rod 7, which on its free end supports a control vane 10 acting as a part of a measuring device. As the second part of a measuring device a component, embodied in this case as a proximity switch 11, is arranged on the tilting cylinder 6 and is in operative connection via an electrical signal line 12 with a logical switching device 13, preferably designed on a relay basis. It would alternatively also be possible to design the logical switching device 13 on an electronic basis. In this case the logical switching device 13 can be actuated by means of a key 14, which is preferably provided in the driver's cab (not represented). Here the tilting cylinder 6 can be actuated by a hydraulic work pump 16, which is driven by a Diesel engine 17 and whose conveying pressure and conveying volume are controllable by means of a regulator 15 in such a way that the volume stream of the adjusting pump 16 is conducted in this example, as explained later, via the line 18 to the piston side 19 of the tilting cylinder 6. Two magnetic valves 20, 21 are furthermore provided, which can be operated by a pilot control pump 22. In this case the magnetic valve 20 cooperates via the line 23 with the tilting piston 24 of the control slide 25, here only partially shown, which is centered between two springs 26, 27. The magnetic valve 21 cooperates via the line 28 with an adjusting cylinder 29, whose piston rod 30 is in operative connection with the tilting piston 24. A pressure control valve 31 is furthermore provided.

The return of the scoop 3 from a tilted-out state, not further represented here, with the lifting frame 1 raised into the represented, approximately horizontally extending position, i.e. approximately parallel with the ground 32, can be approximately represented as follows:

As soon as the automatic scoop return device has been triggered by means of the key 14, the magnetic valve 20 is activated by means of the logical switching device 13 embodied as a relay, so that the tilting piston 24 of the control slide 25, by means of which the scoop tilting mechanism 5 is actuated, is charged with the pressure set at the pressure control valve 31 of the pilot control pump 22. In this example the tilting piston 24 moves toward the left into an end position, so that the hydraulic work pump 16 conveys its oil into the chamber 19 of the tilting cylinder 6 which triggers the tilting movement. The size of this oil flow is a function of the instantaneous rpm of the drive motor 17 (since in connection with wheeled loaders the control opening is of such a size that the oil flow conveyed at or near the maximum rpm of the drive motor can pass through it). In the course of continued extension of the piston rod 7, the support bar 9 connected with it, and therefore also the control vane 10, are correspondingly moved along. Now as soon as the front edge of the control vane 10 reaches the operating range of the proximity switch 11, a signal is triggered which, via the logical switching device 13 and the electrical line 34, activates the magnetic valve 21. The latter now conducts oil from the pilot control pump 22 via the line 28 into the adjusting cylinder 29. In this case the adjusting cylinder 29 has a larger surface than the surface on the other side of the tilting piston 24 which is also charged with control pressure, so that the tilting piston 24 is moved by the differential pressure, additionally aided by the force of the spring 26, so far to the right that the piston of the adjusting cylinder 29 has reached its stop. The position of this stop is selected to be such that the tilting piston 24 releases a control opening 33 which is still large enough so that on the basis of the load-sensing differential pressure set at the regulator 15 of the hydraulic work pump 16, an amount of oil can pass which is approximately equal to or slightly less than the amount of oil which can be conveyed during the idling rpm of the drive motor 17. As soon as in the course of the further extension movement, now slowed, of the piston rod 7 of the tilting cylinder 6 the rear edge of the control vane 10 again leaves the operative range of the proximity switch 11, the latter is deactivated, i.e. its signal drops again. Now both magnetic valves 20, 21 are switched to be currentless by means of the logical switching device 13 via the electrical lines 34, 35, so that the tilting piston 24 is centered in its middle position by means of the force of the springs 26, 27 and thus the oil flow to the tilting cylinder 6 is disrupted, because of which the piston rod 7 and therefore also the tilting mechanism 5 come to a stop.

In this case the length of the control vane 10 should be fixed in such a way that, at the highest rpm of the drive motor 17 and thus with the greatest possible flow conveyed by the hydraulic work pump 16, during the time which passes from the triggering of the proximity switch 11 when the control vane 10 approaches until the stop of the adjusting cylinder 29 has been reached, the piston rod 7 only travels a distance which is equal to or slightly less than the length of the control vane 10. By means of this it is achieved that, as soon as the control vane 10 leaves the operative range of the proximity switch 11 and therefore the magnetic valves 20, 21 are again switched currentless via the logical control device 13 and the electrical lines 34, 35, a defined unchangeable adjustment speed of the piston rod 7 is set which is independent of the rpm of the drive motor and is determined by the size of the control opening occurring in this intermediate position of the tilting piston 24. The now short part of the return path of the tilting piston 24 from this intermediate position into its center position along with the forming of a control opening 33 which shrinks exactly corresponding to the predetermined remaining stroke, and therefore also the predetermined still flowing amount of oil, causes a small but approximately constant further movement of the piston rod 7 until it stops. Once this further movement has been determined experimentally or by calculation, the control vane 10 can be fixed on the support bar 9, so that the desired scoop position results. With the position of the control vane 10 predetermined, this is then unchangeable because of the design in accordance with the invention.

Figure 2:
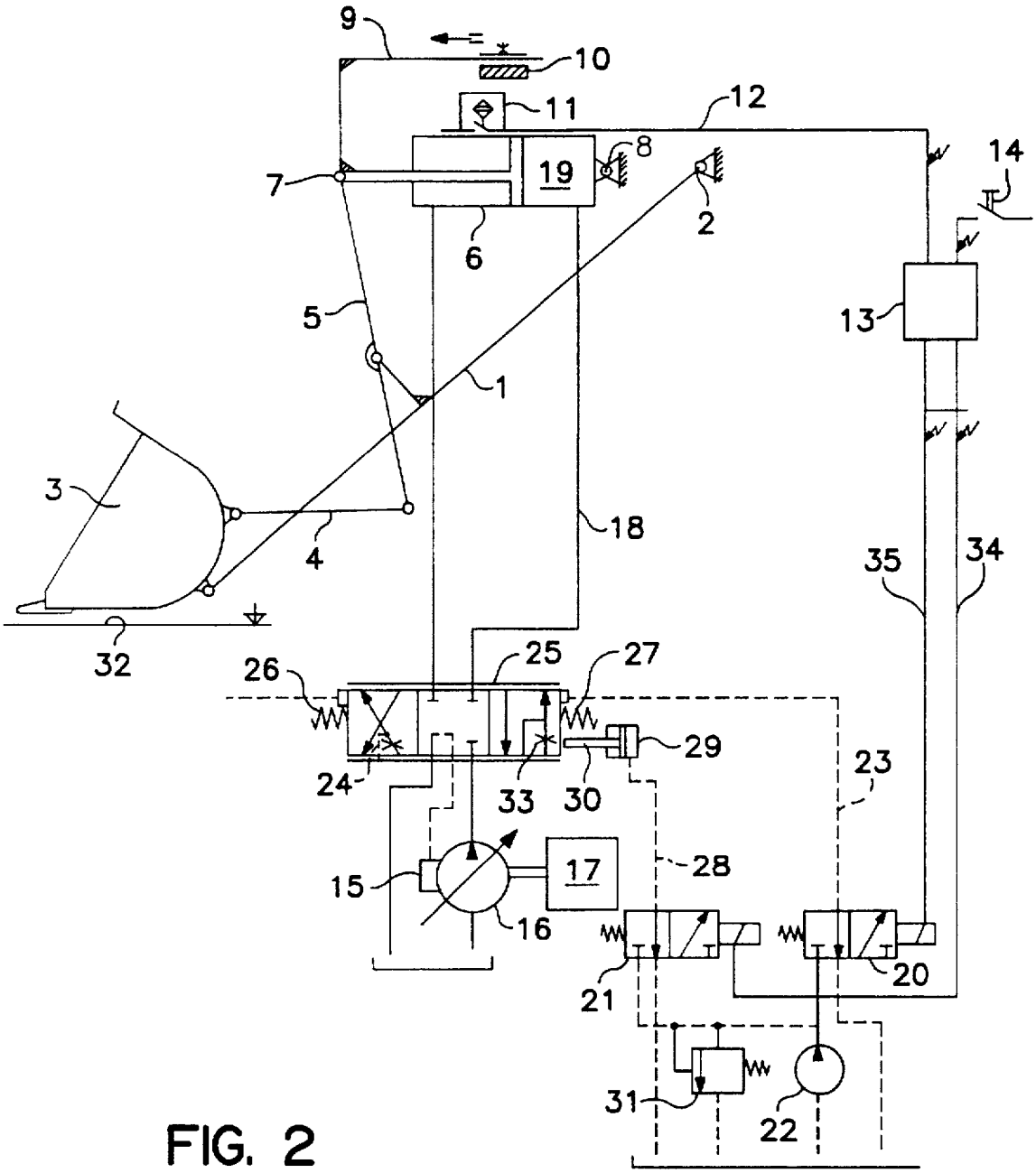
FIG. 2 is a schematic representation of an alternative circuit diagram which may be employed with a backhoe loader.

In a schematic representation, FIG. 2 shows a circuit diagram which is an alternative to that of FIG. 1, which in this example can be employed for a backhoe loader, not further shown. Since essentially the same components are used, of which only a part is actuated differently, the same reference numerals as in FIG. 1 are used.

The lifting frame 1 of the backhoe loader, which is hingedly seated on a hinge point 2 of the loader frame so it can be raised and lowered, is schematically represented. Operating equipment, here embodied as a scoop 3, is hinged at the lower end of the lifting frame 1 and can be actuated by means of a tilting cylinder 6 via a lever mechanism 4, 5. The tilting cylinder 6 contains a piston rod 7 and is itself hingedly fastened in the area of a hinge point 8 on the frame, not further shown, of the backhoe loader. A support bar 9 is fastened to the end of the piston rod 7, which on its free end supports a control vane 10 acting as a part of a measuring device. As the second part of a measuring device a component, embodied in this case as a proximity switch 11, is arranged on the tilting cylinder 6 and is in operative connection via an electrical signal line 12 with a logical switching device 13, preferably designed on a relay basis. It would alternatively also be possible to design the logical switching device 13 on an electronic basis. In this case the logical switching device 13 can be actuated by means of a key 14, which is preferably provided in the driver's cab (not represented). Here the tilting cylinder 6 can be actuated by a hydraulic work pump 16, which is driven by a Diesel engine 17 and whose conveying pressure and conveying volume are controllable by means of a regulator 15, in such a way that the volume stream of the adjusting pump 16 is conducted in this example, as explained later, via the line 18 to the piston side 19 of the tilting cylinder 6. Two magnetic valves 20, 21 are furthermore provided, which can be operated by a pilot control pump 22. In this case the magnetic valve 20 cooperates via the line 23 with the tilting piston 24 of the control slide 25, here only partially shown, which is centered between two springs 26, 27. The magnetic valve 21 cooperates via the line 28 with an adjusting cylinder 29, whose piston rod 30 is in operative connection with the tilting piston 24. A pressure control valve 31 is furthermore provided.

The return of the scoop 3 from a tilted-out state, not further represented here, with the lifting frame 1 raised into the represented, approximately horizontally extending position, i.e. approximately parallel with the ground 32, can be approximately represented as follows:

As soon as the automatic scoop return device has been triggered by means of the key 14, the magnetic valve 20 is activated by means of the logical switching device 13 embodied as a relay, so that the tilting piston 24 of the control slide 25, by means of which the scoop tilting mechanism 5 is actuated, is charged with the pressure set at the pressure control valve 31 of the pilot control pump 22. In this example the tilting piston 24 moves toward the left into its end position, so that the hydraulic work pump 16 conveys its oil into the chamber 19 of the tilting cylinder 6 which triggers the tilting movement. The size of this oil flow is a function of the instantaneous rpm of the drive motor 17. In the course of continued extension of the piston rod 7, the support bar 9 connected with it, and therefore also the control vane 10, are correspondingly moved along. Now as soon as the front edge of the control vane 10 reaches the operating range of the proximity switch 11, a signal is triggered which, via the logical switching device 12 and the electrical line 34, activates the magnetic valve 21 and simultaneously deactivates the magnetic valve 20. The magnetic valve 21 now conducts oil from the pilot control pump 22 via the line 28 into the adjusting cylinder 29. In this case the adjusting cylinder 29 has a surface large enough so that the force generated when it is acted upon by the control pressure is greater than the restoring force of the spring 26 of the tilting piston 24. Now the tilting piston 24 is moved by the force of the adjusting cylinder 29 sufficiently far in the appropriate direction until it has reached the position predetermined by the stop of the adjusting cylinder 29. The position of this stop is selected to be such that the tilting piston 24 still releases a control opening 33 which is large enough that on the basis of the load-sensing differential pressure set at the regulator 15 of the hydraulic work pump 16 an amount of oil can pass which is equal to or slightly less than the amount of oil which can be conveyed during the idle rpm of the drive motor 17. As soon as in the course of the further extension movement, now slowed, of the piston rod 7 of the tilting cylinder 6 the rear edge of the control vane 10 again leaves the operative range of the proximity switch 11, the latter is deactivated, i.e. its signal drops again. Now the magnetic valve 21 is also switched to be currentless by means of the logical switching device 13 via the electrical line 34, so that the tilting piston 24 is centered in its middle position by means of the force of the springs 26, 27 and thus the oil flow to the tilting cylinder 6 is disrupted, because of which the piston rod 7 and therefore also the tilting mechanism 5 come to a stop.

In this case the length of the control vane 10 should be fixed in such a way that, at the highest rpm of the drive motor 17 and thus with the greatest possible flow conveyed by the hydraulic work pump 16, during the time which passes from the triggering of the proximity switch 11 when the control vane 10 approaches until the stop of the adjusting cylinder 29 has been reached, the piston rod 7 only travels a distance which is equal to or slightly less than the length of the control vane 10. By means of this it is achieved that, as soon as the control vane 10 leaves the operative range of the proximity switch 11 and therefore the magnetic valve 21 is again switched currentless via the logical control device 13 and the electrical line 34, a defined unchangeable adjustment speed of the piston rod 7 is set which is independent of the rpm of the drive motor and is determined by the size of the control opening occurring in this intermediate position of the tilting piston 24. The now short part of the return path of the tilting piston 24 from this intermediate position into its center position, forming a control opening 33 which shrinks exactly corresponding to the predetermined remaining stroke, and therefore also the predetermined still flowing amount of oil, causes a small but approximately constant further movement of the piston rod 7 until it stops. Once this further movement has been determined experimentally or by calculation, the control vane 10 can be fixed on the support bar 9, so that the desired scoop position results. With the position of the control vane 10 predetermined, this is then unchangeable because of the design in accordance with the invention.

We claim:

1. A method for the positionally correct placement of an operating equipment including a scoop tiltably disposed on a descending lift frame of a mobile machine including a wheeled loader, the method comprising the steps of:

actuating an automatic positioning device thereby activating a first magnetic valve utilizing a logical switching device cooperating with the automatic positioning device for switching a tilting piston of a control slide operatively connected to a tilting cylinder and to the lift frame into a position in which the control slide releases an oil flow to the tilting cylinder;

conveying the oil flow utilizing a controlled pump;

performing a plurality of measurements of a traveled distance of a piston rod of the tilting cylinder at predeterminable places during a continued extension of the piston rod thereby obtaining distance measurement values;

triggering a first signal in response to a first one of the distance measurement values for activating a second magnetic valve utilizing the logical switching device for moving the tilting piston into a position where a predeterminable reduced oil flow is released to the tilting cylinder; and triggering, during a slowed-down, extending movement of the piston rod, a second signal in response to a second one of the measurement values for deactivating the logical switching device with respect to the first magnetic valve and the second magnetic valve and for interrupting an oil flow to the tilting cylinder.

2. A method for the positionally correct placement of an operating equipment including a scoop tiltably disposed on a descending lift frame of a mobile machine including a wheeled loader, the method comprising the steps of:

actuating an automatic positioning device thereby activating a first magnetic valve utilizing a logical switching device cooperating with the automatic positioning device for switching a tilting piston of a control slide operatively connected to a tilting cylinder and to the lift frame into a position in which the control slide releases an oil flow to the tilting cylinder;

conveying the oil flow utilizing a controlled pump;

performing plurality of measurements of a traveled distance of a piston rod of the tilting cylinder at predeterminable places during a continued extension of the piston rod thereby obtaining distance measurement values;

triggering a first signal in response to a first one of the distance measurement values for simultaneously activating a second magnetic valve and deactivating the first magnetic valve utilizing the logical switching device for moving the tilting piston into a position where a predeterminable reduced oil flow is released to the tilting cylinder; and triggering, during a slowed-down, extending movement of the piston rod, a second signal in response to a further one of the measurement values for deactivating the logical switching device with respect to the first magnetic valve and the second magnetic valve and for interrupting an oil flow to the tilting cylinder.

3. The method according to claim 1, further comprising the step of charging the tilting piston with a pressure previously set at a pressure control valve of a pilot control pump following the step of activating the first magnetic valve.

4. The method according to claim 1, wherein the step of performing the plurality of measurements of the distance traveled by the piston rod includes the step of performing the plurality of measurements in a contactless manner.

5. The method according to claim 1, further comprising the step of leaving a control opening of the tilting piston following a return of the tilting piston, the control opening being sufficiently large such that, based on a load-sensing differential pressure set at a regulator of the pump, an amount of oil can pass through the control opening which is less than an amount of oil which can be conveyed during an idling rpm of a drive motor for the pump.

6. The method according to claim 1, further comprising the step of fixing the measuring points such that, during a highest rpm of a drive motor for the pump and thus a largest possible conveyed flow of the pump, the piston rod travels a distance equal to or less than a length of a control vane during a time elapsing between the step of triggering the first signal and a positioning of the tilting piston by an adjusting cylinder.

7. The method according to claim 2, further comprising the step of fixing the measuring points such that, during a highest rpm of a drive motor for the pump and thus a largest possible conveyed flow of the pump, the piston rod travels a distance equal to or less than a length of a control vane during a time elapsing between the step of triggering the first signal and a positioning of the tilting piston by an adjusting cylinder.

8. A device for executing the method according to claim 1, comprising:

a descending lift frame;

operating equipment including a scoop tiltably disposed on the descending lift frame;

a tilting cylinder operatively connected to the operating equipment for moving the operating equipment and including a piston rod;

a pump operatively connected to the tilting cylinder;

a drive motor operatively connected to the pump for driving the pump;

a control slide including a tilting piston and being operatively connected to the tilting cylinder for triggering the tilting cylinder;

a plurality of magnetic valves operatively connected to the tilting piston for displacing the tilting piston;

a pilot control pump operatively connected to the magnetic valves for acting upon the magnetic valves to displace the tilting piston as a function of a predetermined operating path of the piston rod of the tilting cylinder;

a measuring device disposed adjacent the piston rod for detecting predeterminable traveled distances of the piston rod thereby yielding distance measurement values; and a logical switching device operatively connected to the magnetic valves for triggering the magnetic valves as a function of the distance measurement values of the measuring device.

9. The device according to claim 8, wherein the logical switching device comprises a relay switching device.

10. The device according to claim 8, wherein the pump comprises a hydraulic adjusting work pump having a controllable conveying volume.

11. The device according to claim 8, wherein the measuring device comprises a proximity switch operatively connected with the logical switching device and disposed adjacent the tilting cylinder, the device further comprising a signal line connecting the proximity switch with the logical switching device.

12. The device according to claim 11, further comprising a control vane disposed adjacent the piston rod, the control vane being adapted to be driven over the proximity switch when the piston rod is extended.

13. The device according to claim 8, further comprising an adjusting cylinder and a valve operatively connected to one another and to the control slide for driving the tilting piston as a function of a traveled distance of the piston rod from a completely opened position into a predeterminable partially opened position.

14. The device according to claim 8, further comprising a spring biasing the tilting piston, wherein the adjusting cylinder comprises a piston having a surface larger then a surface of the tilting piston, such that, in response to a differential pressure between the tilting piston and the piston of the adjusting cylinder, and further in response to a force of the spring biasing the tilting piston, the tilting piston is displaced until the piston of the adjusting cylinder has reached a stopping position.

15. The device according to claim 14, wherein the piston of the adjusting cylinder has a surface of such a size that a force generated when a control pressure acts thereon is greater than a restoring force of the spring biasing the tilting piston, the tilting piston thereby being adapted to move only into a position predetermined by a stop of the piston of the adjusting cylinder.

16. The device according to claim 8, further comprising two springs biasing the tilting piston such that, upon a deactivation of the magnetic valves, the tilting piston can be centered in a middle position thereof by the force of the two springs.

* * * * *